US012595151B2

(12) United States Patent
Morgan et al.

(10) Patent No.: US 12,595,151 B2
(45) Date of Patent: Apr. 7, 2026

(54) REEL SPOOLING DEVICE

(71) Applicant: Hoselink Pty Ltd, Brookvale (AU)

(72) Inventors: Andrew Morgan, Brookvale (AU); James Kierath, Brookvale (AU)

(73) Assignee: Hoselink Pty Ltd, Brookvale (AU)

( * ) Notice: Subject to any disclaimer, the term of this patent is extended or adjusted under 35 U.S.C. 154(b) by 114 days.

(21) Appl. No.: 18/393,462

(22) Filed: Dec. 21, 2023

(65) Prior Publication Data

US 2024/0208769 A1 Jun. 27, 2024

(30) Foreign Application Priority Data

Dec. 23, 2022 (AU) ..... 2022903999

(51) Int. Cl.
*B65H 75/44* (2006.01)

(52) U.S. Cl.
CPC ..... *B65H 75/4407* (2013.01); *B65H 2404/10* (2013.01); *B65H 2701/33* (2013.01)

(58) Field of Classification Search
CPC ..... B65H 57/04
USPC ..... 242/397.2, 397.3, 615.2, 615.3
See application file for complete search history.

(56) References Cited

U.S. PATENT DOCUMENTS 2,301,208 A * 11/1942 Gear ..... B65H 75/4486 242/390.8
2,595,655 A * 5/1952 Hannay ..... B65H 75/38 137/355.2
2,606,067 A 8/1952 Roark
2,949,279 A * 8/1960 Eitel ..... F16H 7/18 254/397
3,309,066 A * 3/1967 Carlson ..... B66D 1/28 254/362
3,980,252 A * 9/1976 Tae ..... B65H 54/2812 242/397.3
4,005,834 A * 2/1977 Landreau ..... B65H 75/4407 242/481

(Continued)

FOREIGN PATENT DOCUMENTS

CN 207001913 U 2/2018
WO WO 2017/147656 A1 9/2017

OTHER PUBLICATIONS

First Examination Report issued in Australian Patent Application No. 2023270221, dated Aug. 12, 2025, in 4 pages.

*Primary Examiner* — William A. Rivera
(74) *Attorney, Agent, or Firm* — Knobbe, Martens, Olson & Bear, LLP

(57) ABSTRACT

A reel spooling device includes a reel adapted to store a spooled length of hose or conduit and a lead screw mechanically coupled to the reel and configured to rotate about a longitudinal axis when the reel rotates. A guide cartridge is seated on the lead screw and configured to reciprocate between opposing first and second ends of said lead screw. The guide cartridge includes a first pair of rollers which are spaced relative to each other and rotatable about first and second axes, defining a first restriction. A second pair of rollers are spaced relative to each other and rotatable about third and fourth axes, defining a second restriction. The first, second, third and fourth axes are each generally parallel, and the first and second restrictions are separated relative to a longitudinal direction in which the hose or conduit passes through the guide cartridge.

20 Claims, 10 Drawing Sheets

(56) References Cited

U.S. PATENT DOCUMENTS

| | | | | |
|---|---|---|---|---|
| 4,616,791 | A * | 10/1986 | Harvey | B65H 75/4407 242/397.2 |
| 5,385,314 | A * | 1/1995 | Hughes | B65H 54/2866 242/397.3 |
| 8,061,644 | B1 * | 11/2011 | Dion | B65H 75/4405 242/157.1 |
| 11,165,230 | B1 * | 11/2021 | Jordan | H02G 1/02 |
| 11,174,122 | B2 * | 11/2021 | Dion | B65H 75/4402 |
| 12,234,130 | B2 * | 2/2025 | Vaughn | B66D 1/56 |
| 12,312,208 | B2 * | 5/2025 | Blanchard | B65H 75/4471 |
| 2004/0238676 | A1 | 12/2004 | Tisbo et al. | |
| 2006/0273213 | A1 * | 12/2006 | Turk | B65H 75/4407 242/397.3 |
| 2015/0298936 | A1 * | 10/2015 | Haldorsen | B65H 75/4402 242/397.3 |
| 2016/0362948 | A1 * | 12/2016 | Baugh | E21B 19/008 |
| 2019/0322481 | A1 | 10/2019 | Dion | |
| 2020/0095088 | A1 | 3/2020 | Kierath | |
| 2023/0159300 | A1 * | 5/2023 | Tu | B65H 75/4481 242/389 |

* cited by examiner

REEL SPOOLING DEVICE

CROSS-REFERENCE TO RELATED APPLICATIONS

The present application claims the priority of Australian application No. AU2022903999, titled REEL SPOOLING DEVICE and filed Dec. 23, 2022, the disclosure of which is incorporated by reference herein in its entirety.

BACKGROUND

Technical Field

The present disclosure relates to a reel spooling device. In particular, the present application relates to a hose reel spooling device for use with irrigation hoses. However, it will be appreciated by those skilled in the art that the reel spooling device disclosed herein can be used with other hoses for liquid or gas distribution, compressed air, or for spooling cables or conduits such as power, data and other such products.

Description of Related Art

Hoses and other conduits and cables are often mounted on a spool for storage and/or transportation. Using a retractable reel enables the hose or conduit to be unwound as desired when in use, and retracted onto the spool and neatly stored when inactive.

Hoses are widely used in residential gardens, courtyards, commercial settings and other applications. However, there are various challenges faced when trying to store the hose when not in use, in a manner that is tidy and easily redeployed. If the hose is coiled or otherwise left on the ground, the inactive hose may be rather unsightly, and may pose a hazard for people tripping. Furthermore, people with reduced mobility may be unable to easily retrieve the hose or nozzle when it is located on ground level.

Surface mounted hose hangers are commonly mounted on walls and other such vertical surfaces. Whilst such hose hangers provide some benefits with respect to neatly storing the hose, there are still several inherent drawbacks. For example, the user must manually spool the length of hose onto the hanger after use. Furthermore, before moving away from the hose hanger, the user must uncoil a length of hose, by estimating how far away from the hanger they may walk. It is common for a user to walk some distance from the hose hanger and subsequently realise that they do not have a sufficient length of unspooled hose. This may necessitate the user to return to the hose hanger to unspool several additional coils. As such, the use of such hose hangers may be cumbersome and impractical. Furthermore, hoses stored on such hose hangers are prone to becoming tangled.

In recent years, there has been a trend toward fully enclosed hose reels. The design of such hose reels may include an auto retract mechanism to retract the hose into the reel as the user returns toward the tap outlet. This process obviates the need for the user to manually coil the hose, which is advantageous.

A problem with existing enclosed hose reels is the tendency for the hose to become misaligned on the spool. In practice, while the reel is spinning during the retraction process, if the hose suffers from any alignment problem, and is not evenly seated in neat rows about the rotation axis of the spool, then the misalignment may result in jamming of the hose reel. In existing auto retracting hose reels, such a misalignment may be difficult to correct, especially for people with limited technical skill. It is often necessary to manually remove a belt if this occurs, and then manually realign the spool, which is a complicated process.

If the layers of hose are not evenly seated on the underlying layers, there is a tendency for the spooled hose to occupy more space than would be required for a neatly spooled hose. As such, the size of the casing of the reel is typically designed to accommodate the hose having a less then optimal arrangement. As a result, the casing typically has a large form factor for a given hose length and diameter, and this can detract from the visual appearance of the product.

In order to achieve improved spool layering, some reels include a guide which is located at or near the opening where the hose enters the housing. The guide is often provided in the form of a pair of diametrically opposed rollers which attempt to prevent the hose from arriving onto the spool at an angle which is greatly divergent relative to a tangent extending from the current, local outer radius of the spool, and preferably perpendicular to the axis of rotation of the spool.

This style of guide can be particularly useful for scenarios where the hose is being drawn from the reel at a slight angle. However, there are still problems when the hose reel is mounted to a wall, and the length of hose has been retracted at large angle, for example, around a corner, such that the hose is running near parallel to the rotation axis of the spool. Similarly issues will be encountered when the hose reel is truck mounted, if the hose is withdrawn parallel to the rotational axis of the spool. In such scenarios, the guide is unlikely to be able to generate even spool formation.

Whist the inclusion of a guide somewhat assists the spool to be neatly wound, there are still spooling errors which may occur when using existing guides, and for this reason existing guides do not sufficiently overcome the possibility of spooling errors.

The summary presented above regarding some existing hose reels does not constitute an acknowledgement in any way that those earlier devices are considered to be part of the "common general knowledge" within the meaning of Section 7(2) of the Australian Patents Act 1990 (Cth).

The present application discloses techniques to substantially overcome or at least ameliorate one or more of the above disadvantages, or to provide a useful alternative.

SUMMARY

In a first aspect, the present application provides a reel spooling device comprising:

- a reel adapted to store a spooled length of hose or conduit;
- a lead screw mechanically coupled to the reel and configured to rotate about a longitudinal axis when the reel rotates;
- a guide cartridge seated on the lead screw, the guide cartridge configured to reciprocate between opposing first and second ends of said lead screw;

wherein the guide cartridge includes:

- a first pair of rollers which are spaced relative to each other and rotatable about first and second axes, the first pair of rollers defining a first restriction;
- a second pair of rollers which are spaced relative to each other and rotatable about third and fourth axes; the second pair of rollers defining a second restriction;

wherein the first, second, third and fourth axes are each generally parallel, and the first and second restrictions are separated relative to a longitudinal direction in which the hose or conduit passes through the guide cartridge.

The guide cartridge preferably includes a third pair of rollers which are spaced relative to each other and rotatable about fifth and sixth axes; the third pair of rollers defining a third restriction.

Preferably the fifth and sixth axes are generally perpendicular to the first, second, third and fourth axes.

The third pair or rollers are located in between the first and second pairs of rollers.

Preferably each roller has a right circular cylinder roller surface.

The lead screw preferably has overlaid left and right hand threads, and the guide cartridge includes a follower tooth configured to engage with one of the left and right hand threads.

The guide cartridge preferably includes a removable tooth holder.

The tooth holder is preferably attached to a body portion of the guide cartridge with a pair of bayonet connections.

The bayonet connections are preferably releasable by squeezing a pair of wings formed on the tooth holder.

The guide cartridge preferably includes upper and lower projections which each extend generally parallel with the lead screw, the upper and lower projections being mounted in corresponding upper and lower channels formed within a housing unit of the reel spooling device, wherein the projections are slidable within the channels.

BRIEF DESCRIPTION OF THE DRAWINGS

A preferred embodiment of the reel spooling device will now be described by way of specific example with reference to the accompanying drawings, in which.

DETAILED DESCRIPTION

Figure 1:
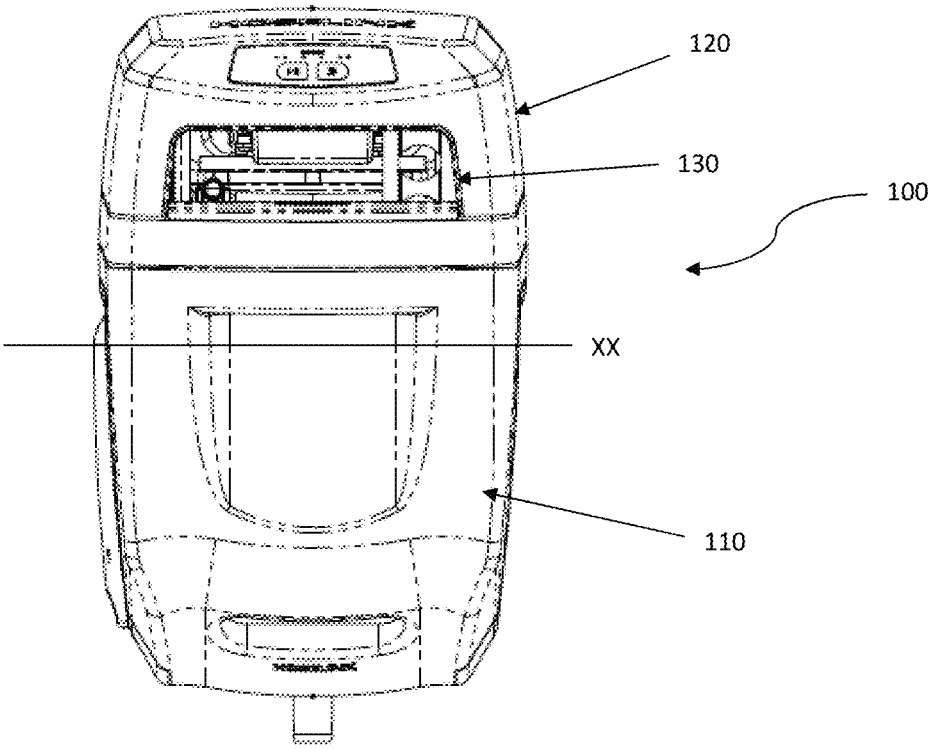
FIG. 1 is a front view of a hose reel.

A hose reel 100 is disclosed herein. Referring to FIG. 1, the hose reel 100 includes a body 110. The hose reel 100 may be surface mounted, for example to a wall or other structure. Alternatively, it may be free standing or vehicle mounted.

Whilst the hose reel 100 is described with respect to water hoses, it will be appreciated that it can alternatively be used with other hoses for liquid or gas distribution, including compressed air, or for spooling cables or conduits such as power, data and other such products.

The hose reel 100 includes two side casings, which define an enclosure.

Within the body 110, a spool is seated on a spool shaft assembly.

A window or external opening 130 is formed in the body 110. The window 130 permits a hose to enter the hose reel 100, such that the hose is wound onto the spool. The width of the window 130 enables the hose to move longitudinally relative to an axis of rotation XX of the internal hose spool.

The hose reel 100 includes a guide mechanism 300, to prevent the layering of the hose from becoming unsynchronised or uneven as the spool is wound during retraction. The guide mechanism 300 includes a guide cartridge 310 depicted in isolation in FIGS. 2 to 4.

Figure 5:
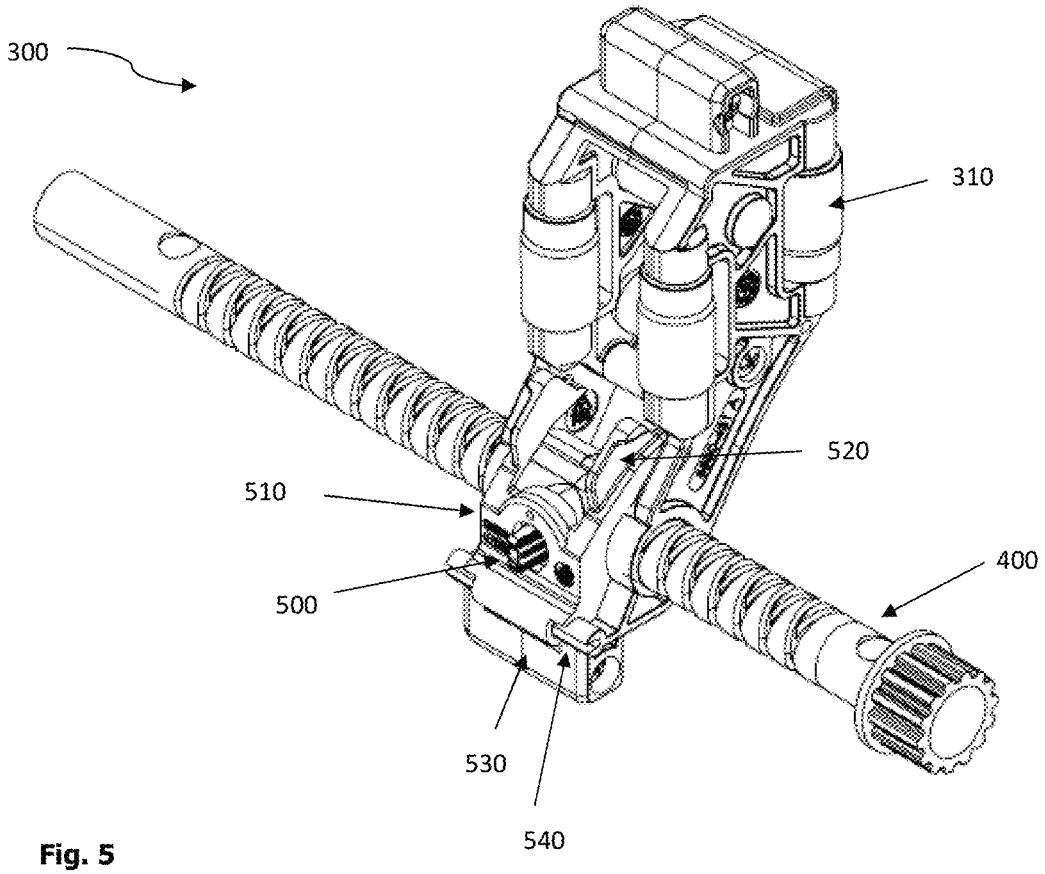
FIG. 5 is a perspective view of the cartridge of FIG. 2 mounted on a lead screw.
Figure 6:
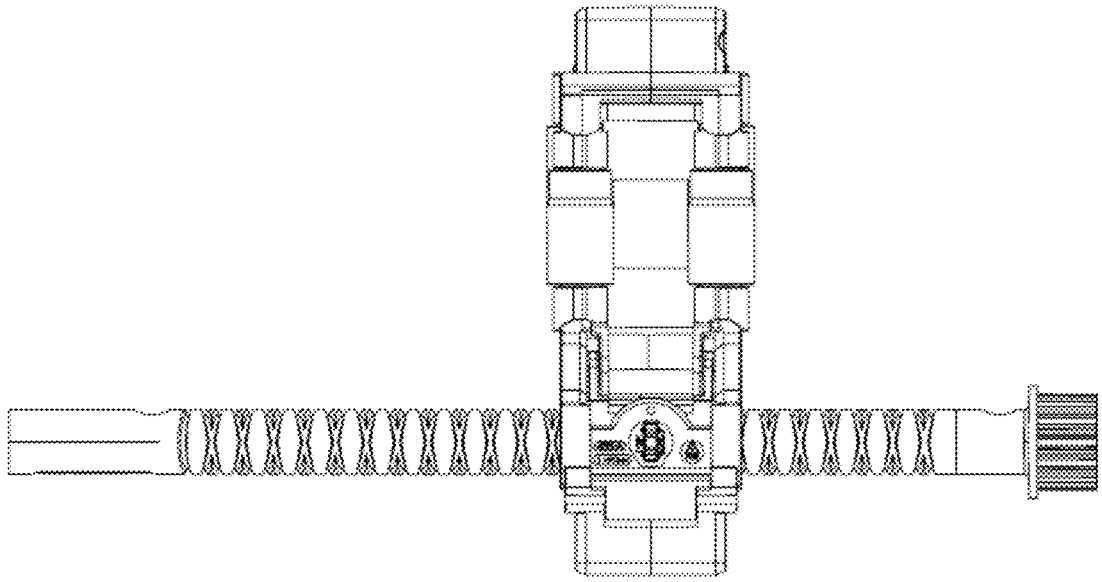
FIG. 6 is a front view of the lead screw and cartridge of FIG. 5.

The guide mechanism 300 also includes a lead screw 400, shown in FIGS. 5 and 6. The lead screw 400 is threaded and has two sets of threads, that is, a right hand thread and an overlayed left hand thread. The two threads are interconnected making a continuous thread which loops back on itself.

The guide mechanism 300 is removably fitted within the top cover 120 with a pair of projections or brackets 320, 330 formed on upper and lower regions of the guide cartridge 310. The projections 320, 330 are seated within corresponding upper and lower channels which in a preferred embodiment are integrally formed within the body 110. However, it will be appreciated that the channels may be separately formed and attached. For example, the channels could be fabricated from aluminium or a suitable polymer, and attached with fasteners or adhesive.

In an alternative embodiment (not shown), the projections or brackets 320, 330 are substituted for through holes which extend through the body of the guide cartridge 310. The through holes are configured to receive rods (not shown), the rods having first and second opposing ends secured to the internal walls of the hose reel body 110. Each embodiment is analogous in so far as the guide cartridge 310 is permitted to move along an axis which is parallel with an axis of rotation of the hose reel 100.

The engagement between the projections 320, 330 (or through holes) and the channels (or rods) allows the guide mechanism 300 to move laterally as the lead screw 400 is rotated. In this manner, the guide mechanism 300 can move in a reciprocating fashion between the two sides of the window 130.

Figure 4:
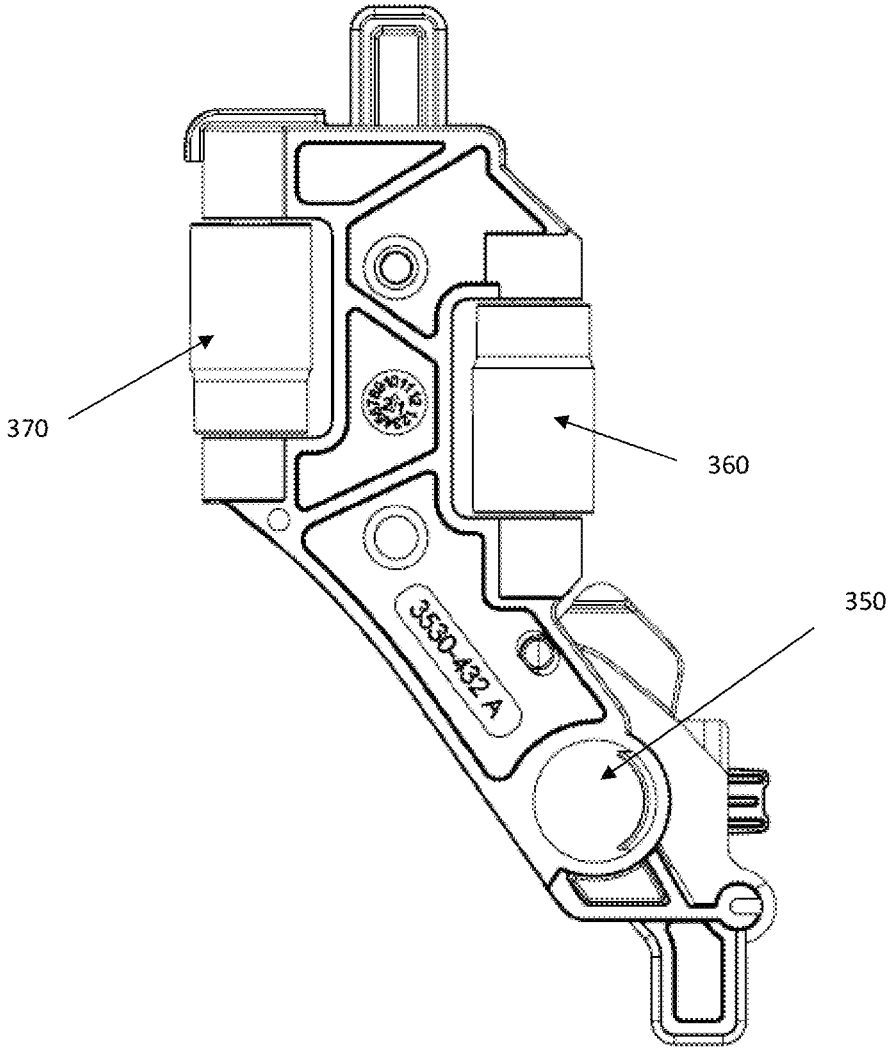
FIG. 4 is a side view of the guide cartridge of FIG. 3.

Referring to FIG. 4, the guide cartridge 310 includes a through hole 350. The hole 350 is adapted to receive the lead screw 400, as shown in FIG. 5.

Figure 2:
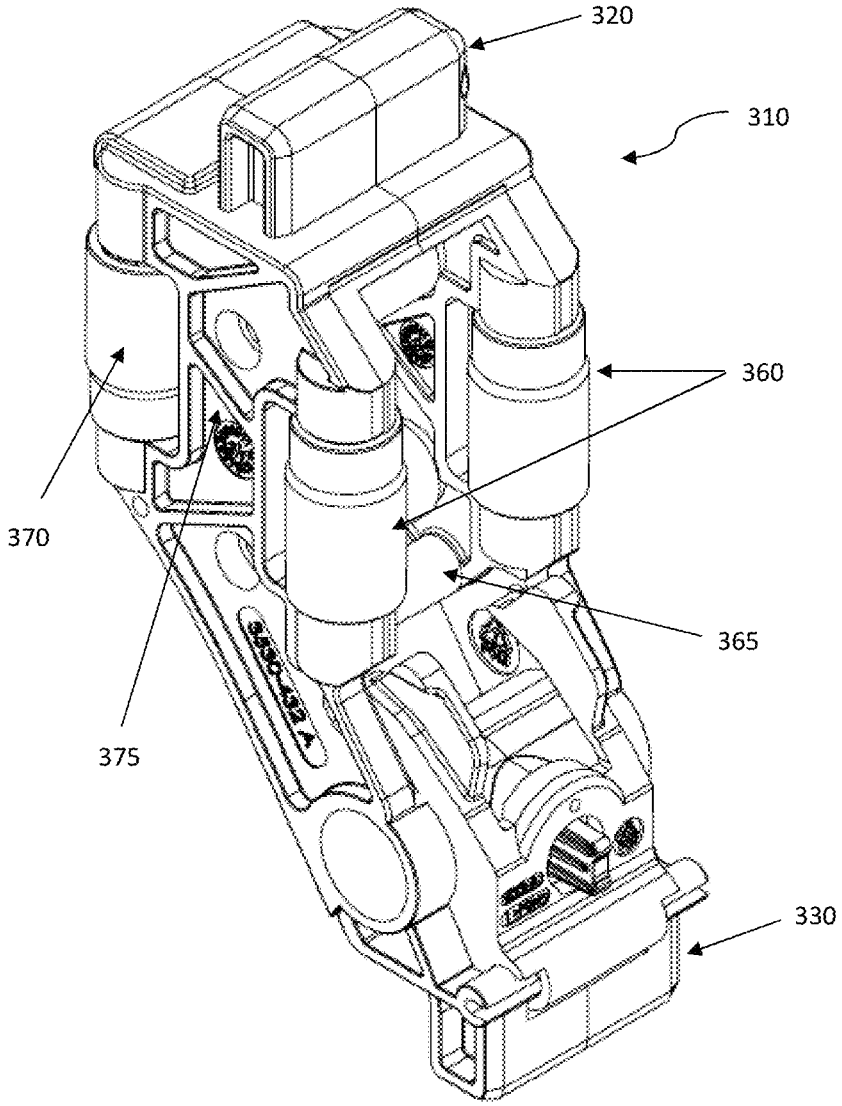
FIG. 2 is a perspective view of a guide cartridge of the hose reel of FIG. 1.

Referring to FIG. 2, the guide cartridge 310 includes a first pair of rollers 360 which are spaced relative to each other and generally parallel. An opening 365 located between the first pair of rollers 360 is sized to receive a specific gauge of garden hose (not shown), for example having an outer diameter of around 16.5 or 17.8 mm. It will be appreciate that the diameter of the hose may be specific for a particular market, and the clearance between the rollers 360 is provided based on local market conditions.

The first pair of rollers 360 are mounted to freely rotate around first and second roller axes located on a first plane. The first plane is preferably vertical or near vertical. The first plane extends generally perpendicular relative to a longitudinal axis of the hose passing through the guide cartridge 310.

As depicted in FIG. 2, the first pair of rollers 360 are each stepped, or otherwise reduced in diameter, such that the diameter of each roller decreases slightly toward the top and/or bottom of each roller. This local reduction in roller 360 diameter enables a fitting, typically a low profile quick connect fitting, which is crimped or otherwise attached to the end of the hose to pass between the first pair of rollers 360. This local increase in the opening between the two rollers 360 enables the end of the hose with a fitting attached thereto to be passed from outside the hose reel 100 to the centre of the hose reel 100 with minimal effort, for attachment to the central spool. Advantageously, this feature obviates the need to separately attach the fitting to the hose, and the hose and fitting can be supplied to the consumer preassembled.

Referring to FIG. 2, the guide cartridge 310 also includes a second pair of rollers 370 which are spaced relative to each other and generally parallel. An opening 375 located between the second pair of rollers 370 is also sized to receive a specific gauge of garden hose (not shown), for example around 20 mm. The second pair of rollers 370 are mounted to freely rotate around third and fourth roller axes located on a second generally vertical plane. The second generally vertical plane is also perpendicular relative to a longitudinal axis of the hose passing through the guide cartridge 310. The second pair of rollers 370 also have a region where the diameter of each roller decreases slightly toward the top and/or bottom of each roller. This local reduction in roller diameter is also provided to enable the hose fitting to pass between the rollers 370.

The first and second planes are separated, and each extend generally parallel with the axis of rotation of the lead screw 400, and are also separated relative to a longitudinal direction in which the hose passes through the guide cartridge 310. As such, the first pair of rollers 360 and the second pair of rollers 370 provide two distinct and separate points of restriction, which limit and define the nature of the hose path during winding and unwinding of the reel.

Referring to FIG. 4, the second pair of rollers 370 are located vertically higher than the rollers first pair of rollers 360. This is due to the hose normally exiting from the reel 100 in a downwardly inclined position, especially when the hose is not in use. In addition, the vertical staggering of the second pair of rollers 370 relative to the first pair of rollers 360 enables the hose reel 100 external dimensions to be minimised.

Figure 3:
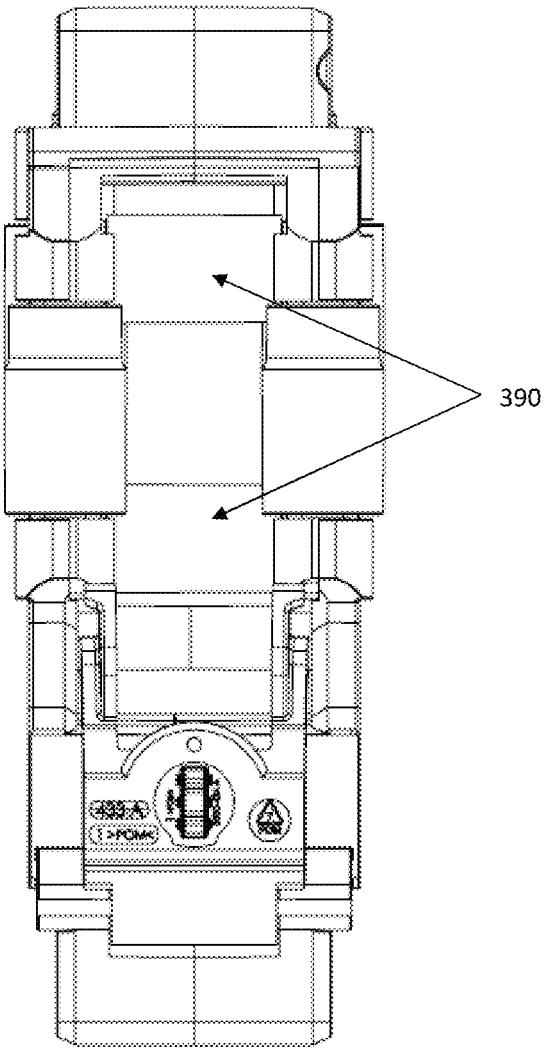
FIG. 3 is a is a front view of the guide cartridge of FIG. 2.

In a preferred embodiment, the guide cartridge 310 also includes a third pair of rollers 390 as shown in FIG. 3. The third pair of rollers 390 are mounted respectively above and below the hose, and rotate about a horizontal axis, around fifth and sixth roller axes. In this arrangement, the horizontally extending third pair of rollers are seated between the first pair of rollers 360 and the second pair of rollers 370. However, it will be appreciated that in an alternative arrangement, the third pair of rollers 390 may be located either in front or at the rear of the first and second pairs of rollers 370, 390.

The interaction between the hose and the first pair of rollers 360 and the second pair of rollers 370 serves to guide the hose, especially if the hose is being withdrawn or retracted at an angle that is not close to perpendicular to the axis of rotation of the lead screw 400. In contrast, the third pair of rollers 390 provide guidance when the angle of the hose from the window 130 is non-horizontal, for example if the hose reel 100 is mounted close to the ground, or alternatively if the user has walked up or down stairs or an incline with the hose nozzle.

In the preferred embodiment depicted in FIGS. 1 to 8, the rollers are each right circular cylindrical rollers. However, other arrangements are envisaged, including the exclusion of the third pair of horizontally extending rollers 390.

In one embodiment, the rollers 390 may be contoured or have groves formed in them to centre the hose.

Figure 9:
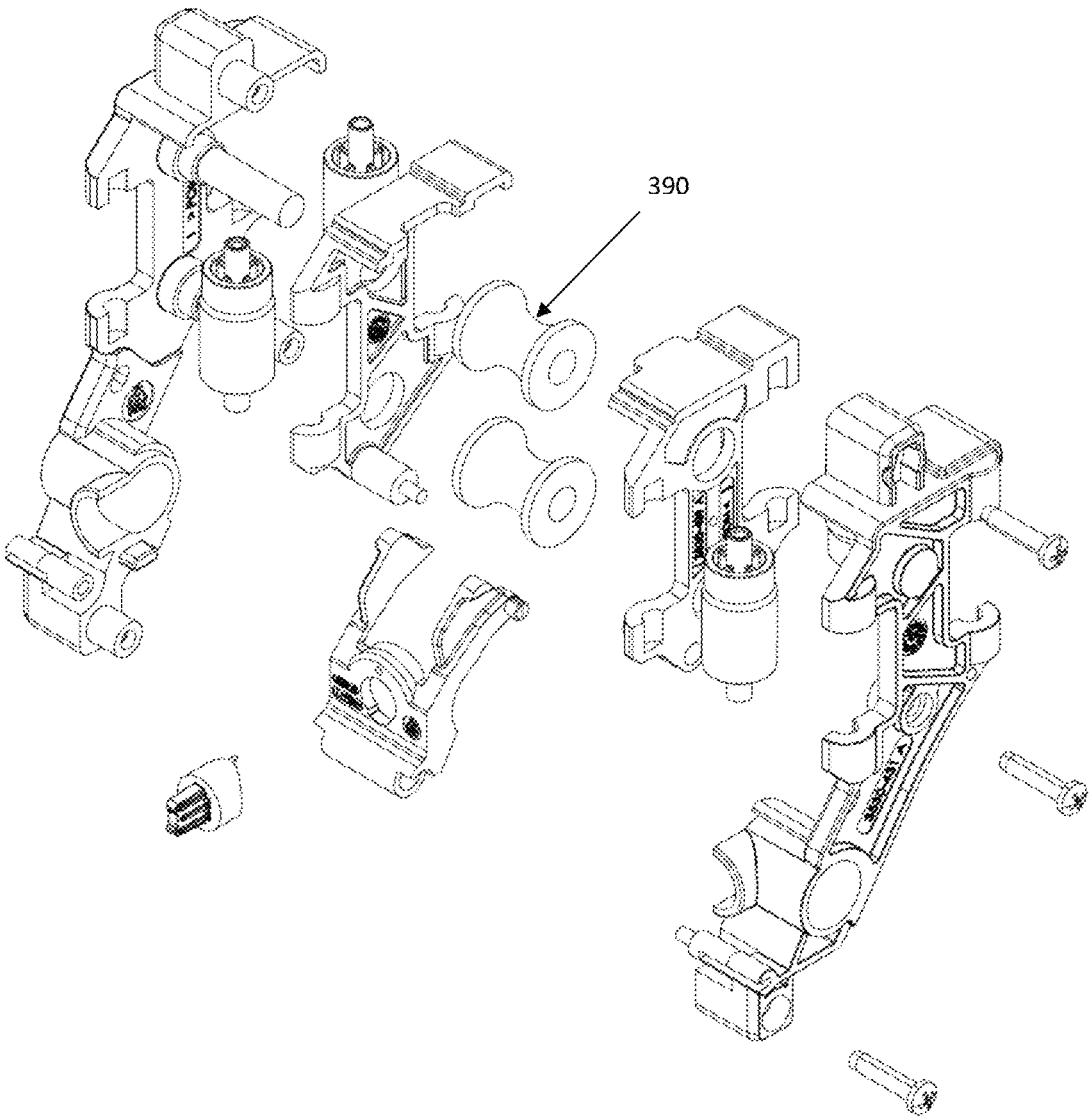
FIG. 9 is an exploded view of a second embodiment of the guide cartridge.
Figure 10:
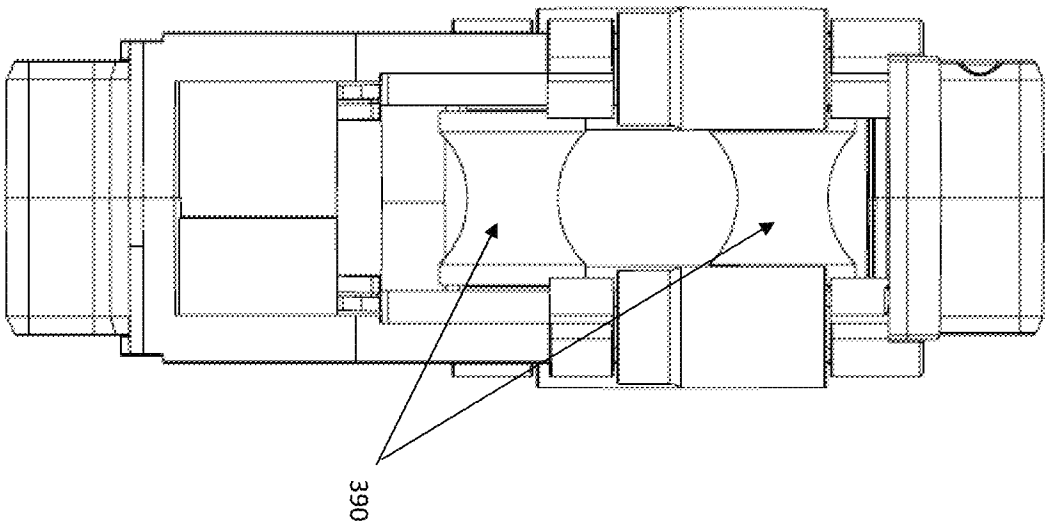
FIG. 10 is a front view of the guide cartridge of the second embodiment.
Figure 11:
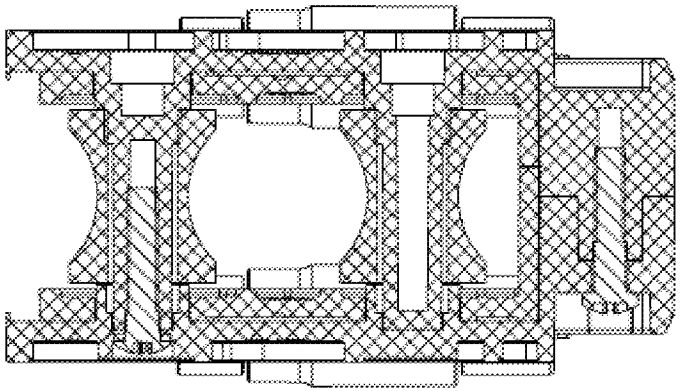
FIG. 11 is a cross-sectional front view, taken through a vertical plane which passes through a longitudinal axis of the horizontal rollers.

In another embodiment shown in FIGS. 9 and 10, the third pair of rollers 390 are each formed having a semi-circular groove, corresponding in shape to the outer diameter of the intended hose. In each arrangement, there are at least two pairs of rollers, each pair being separated by space to provide two distinct and separate points of restriction for guiding the hose in or out of the hose reel 100.

The guide cartridge 310 includes a direction changing member in the form of a tooth 500 which is pivotally mounted to the guide cartridge 310. The tooth 500 is mounted to the guide cartridge 310 in a manner that is pivotal relative to the guide cartridge 310.

The tooth 500 is adapted to follow the thread of the lead screw 400. Referring to FIGS. 5 and 6, a leading end of the tooth 500 is arcuate, and configured to follow the circumferential curvature around the threads formed in the lead screw 400.

Each time the guide cartridge 310 approaches one of the two opposing ends of the lead screw 400, the tooth 500 pivots so that it changes from the right hand thread to the left hand thread, such that the guide cartridge 310 reciprocates between the two opposing ends of the lead screw 400. This has the effect of stacking the hose in neat rows, such that each radial layer of hose is stacked in an opposing longitudinal direction.

Referring to FIG. 5, the tooth 500 is readily removable from the guide cartridge 310 by a consumer or technician. A tooth holder 510, best seen in FIG. 7, locks into position by means of a bayonet type engagement formation. This means that in operation, if the hose becomes stuck, or the reel jams, for example due to a hose winding error, the user can manually remove the tooth cover 510 to temporarily disengage the guide cartridge 310 relative to the lead screw 400. Once the problem has been resolved, the user can manually re-engage the tooth 500 by locking it into the guide cartridge 310 by replacing the tooth cover 510. The tooth cover 510 has two wings 520, 522 which each include a laterally extending pin 524. When the wings 520, 522 are squeezed together, the pins 524 disengage from corresponding holes 525 formed in the guide carriage 310, enabling the tooth cover 510 to be disengaged from the guide cartridge 310. At a lower end of the tooth cover 510, an internal through hole 530 engages with a shaft 540, such that the through hole 530 is seated on the shaft 540. During assembly of the guide cartridge 310, the left and right frame assemblies 550, 552 are connected with three screws 554. During this assembly process, the through hole is seated on two opposing projections 538, which define the shaft 540 when the projections 538 come into abutment.

In an alternative arrangement, the tooth holder 510 is secured to the guide cartridge 310 with screws or other fasteners.

Figure 7:
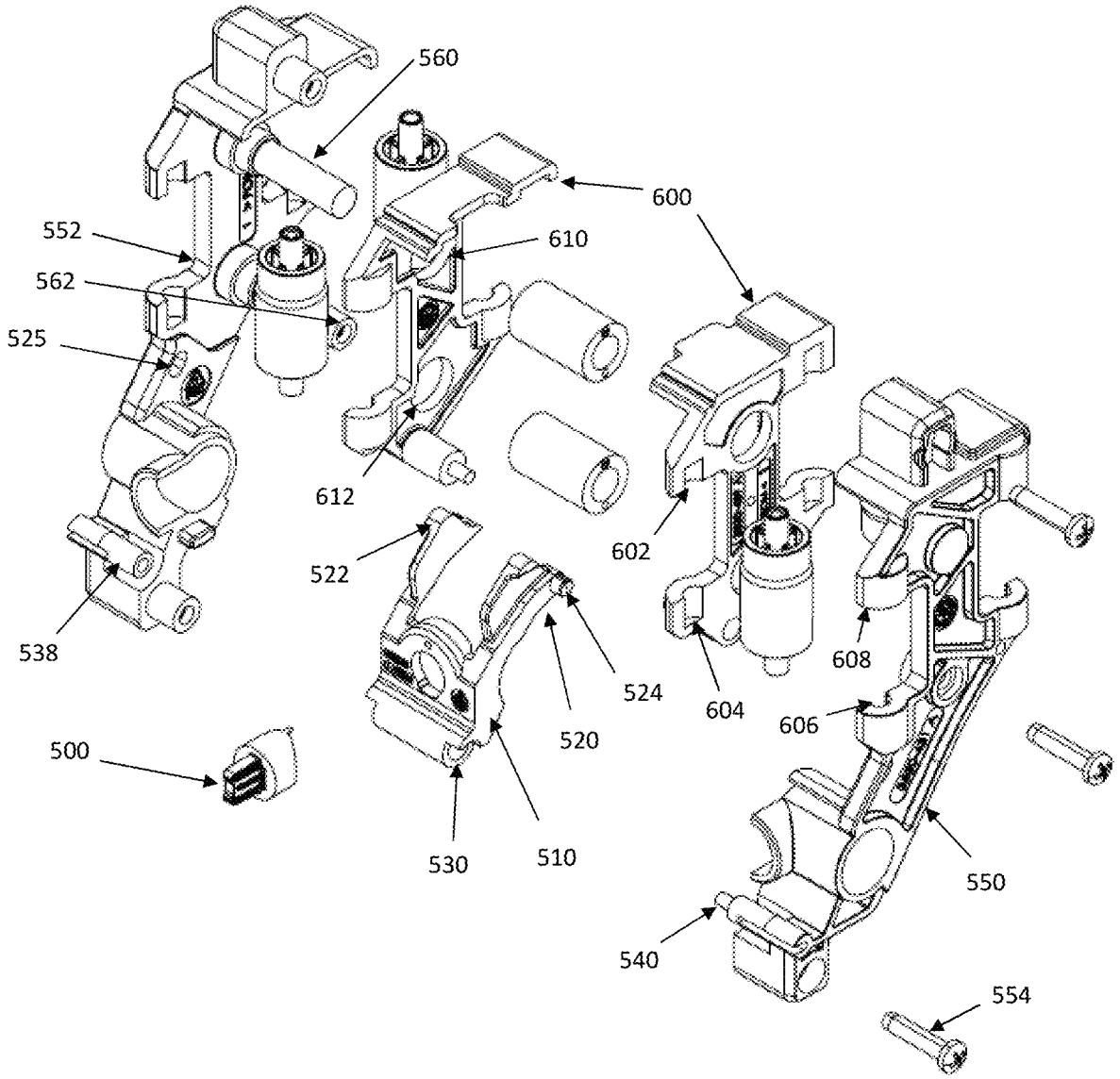
FIG. 7 is an exploded perspective view showing the components of the guide cartridge.
Figure 8:
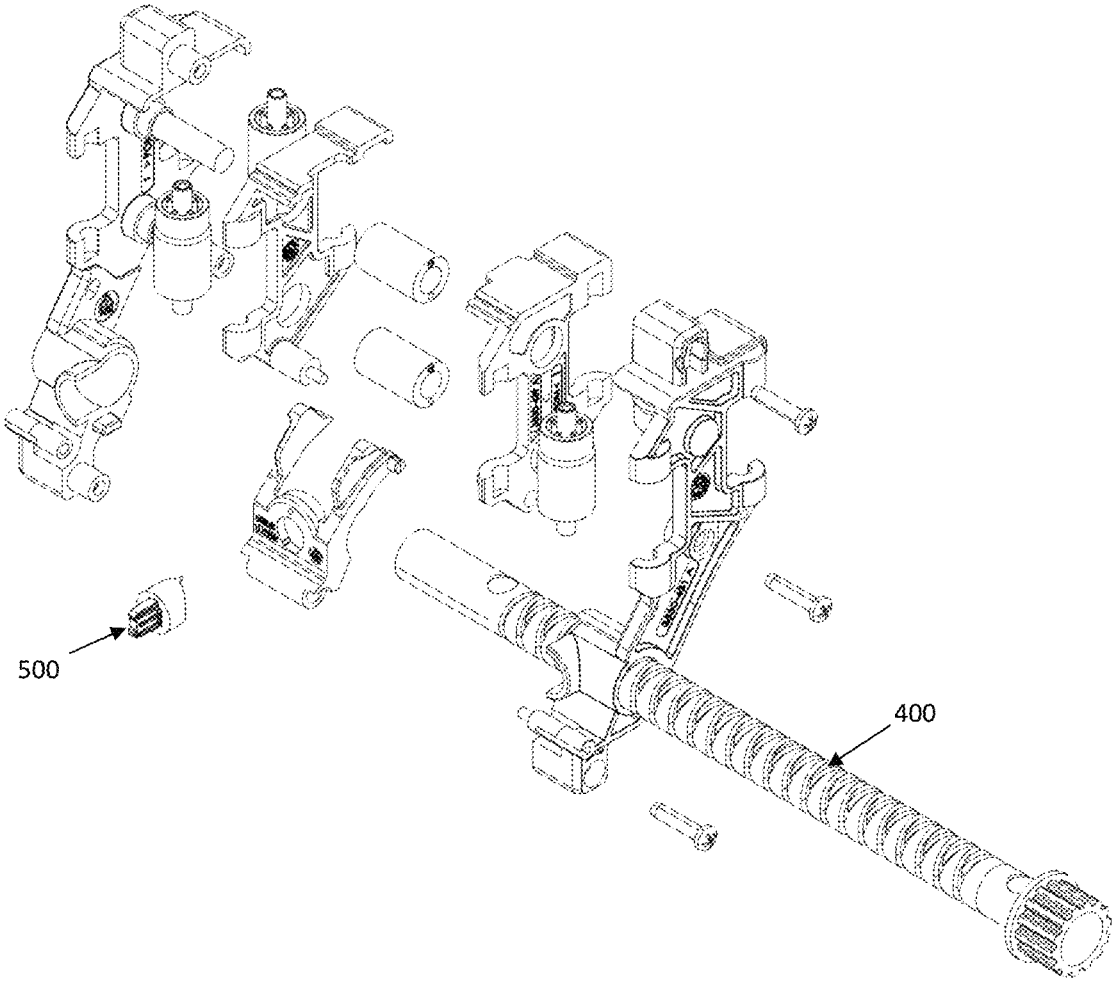
FIG. 8 is another exploded view and further includes the lead screw.

Referring to FIG. 7, the guide cartridge 310 includes two locking plates 600. As best seen in FIG. 7, each guide plate 600 has a pair of recessed bearing surfaces 602, 604, which interact with a pair of corresponding bearing surfaces 606, 608 on each of the right and left frame assemblies 550, 552. In this way, when one of the frame assemblies 550, 552 is secured to the adjacent guide plate 600, the stub shafts of the two vertically extending rollers, that is the first pair of rollers 360 and the second pair of rollers 370 are sandwiched between the frame assembly 550, 552 and the guide plate 600.

The bearing surfaces 602, 604, 606, 608 correspond with the stub shafts extending from each of the first pair of rollers 360 and second pair of rollers 370. In particular, the bearings and shafts are different at upper and lower ends, such that the first pair of rollers 360 and second pair of rollers 370 cannot be mistakenly installed upside down.

The third pair of rollers 390 may also be directionally mounted to the shafts 560, 562, such that the rollers have a single way of being mounted to avoid any assembly errors.

As shown in FIG. 7, each guide plate 600 has two holes 610, 612 which are configured to receive shafts 560, 562 which support the third pair of rollers 390.

When the right and left frame assemblies 550, 552 are secured together with the screws 554, the shafts 560, 562 extend between the right and left frame assemblies 550, 552, and the guide plates 600 are sandwiched between the right and left frame assemblies 550, 552. In this assembled state, each of the first pair of rollers 360, second pair of rollers 370 and third pair of rollers 390 are secured to and rotatable relative to the guide cartridge 310.

A gear is seated on the lead screw 400 with a spline connection to prevent the gear from rotating relative to the lead screw 400. The gear includes teeth for meshing with a belt which is driven by a spool drive gear seated on the spool. The drive gear is shielded by a gear cover.

The spool is driven by a spring, such that the spring is energised when the user pulls out the hose, which charges the spring for subsequent retraction of the hose at a later time.

If the hose becomes stuck, or otherwise unsynchronised, and the guide cartridge 310 is blocked, the user can open the tooth cover 510 to withdraw the tooth 500 from engagement with the thread formed in the lead screw 400. This has the effect of freeing the guide cartridge 310 such that it can move longitudinally relative to the lead screw 400. The user can then manually pull the hose out of the reel to withdraw the hose. Once the blockage is resolved, the user can simply re-engage the tooth 500 with the thread formed on the lead screw 400, or install a replacement tooth 500.

A side of the housing 110 of the hose reel 100 has an aperture for receiving a length of hose which is connected to a tap outlet. The hose is connected at a down-stream end to an inlet stem which is in fluid communication with the reel's rotation axle.

A central, toothed wheel is seated on the spool. The toothed wheel is configured to drive the belt, which in turn rotates the lead screw 400. In this way, the lead screw 400 rotates in response to the spool rotating, and the rotational direction (forward/rearward) of the lead screw 400 corresponds with the rotational direction of the spool.

As described above, the lead screw 400 is mechanically coupled to the spool. This is achieved with a belt, chain, gears or another drive mechanism.

In an alternative embodiment, the guide cartridge 310 may be controlled by a motorised mechanism that doesn't rely on a belt or other such mechanical coupling. In contrast, in that embodiment, the motor output is coupled with the lead screw 400. Optical sensors are used to synchronise the spool to the lead screw 400. In such an arrangement, the lead screw 400 is motorised, and takes direction from the spool to activate an electric motor to drive the lead screw at the correct RPM based on the RPM of the spool.

Advantageously, the housing form factor of the housing can be minimised due to the reduced likelihood of the hose winding being unsynchronised.

Advantageously, the tooth 500 can be readily removed and/or replaced by the consumer with minimal technical expertise.

Advantageously, the guide cartridge 310 guides the hose in multiple directions simultaneously. In particular, the reciprocation from side to side promotes even layering, and the first pair of rollers 360 and second pair of rollers 370 direct the hose to join the spool at an angle that is approximately perpendicular to the angle of rotation of the spool. These two hose guiding mechanisms act together to provide improved hose spooling performance, with a reduced risk of spooling errors.

Advantageously, in the event of an error, the tooth 500 can be readily and simply removed by the user to enable a reset of the spool.

Although the reel spooling device has been described with reference to specific examples, it will be appreciated by those skilled in the art that the device may be embodied in many other forms.

What is claimed is:

1. A reel spooling device comprising:

a reel adapted to store a spooled length of hose or conduit;

a lead screw configured to rotate about a longitudinal axis when the reel rotates; and a guide cartridge seated on the lead screw, the guide cartridge configured to reciprocate between opposing first and second ends of said lead screw, wherein the guide cartridge includes:

a first pair of rollers which are spaced relative to each other and each rotatable about a first axis and a second axis respectively, the first pair of rollers forming a first restriction; and a second pair of rollers which are spaced relative to each other and each rotatable about a third axis and a fourth axis respectively, the second pair of rollers forming a second restriction, wherein the first axis, the second axis, the third axis, and the fourth axis are each generally parallel, and wherein the first restriction and the second restriction are separated relative to a longitudinal direction in which the hose or conduit passes through the guide cartridge, wherein the lead screw has overlaid left and right-hand threads, wherein the guide cartridge includes a follower tooth configured to engage with one of the left and right-hand threads, and wherein the guide cartridge includes a removable tooth holder.

2. The reel spooling device of claim 1, wherein each of the first axis, the second axis, the third axis, and the fourth axis extend generally vertically and are perpendicular to the longitudinal axis.

3. The reel spooling device of claim 1, wherein the lead screw is mechanically coupled to the reel.

4. The reel spooling device of claim 1, wherein the lead screw is driven by an electric motor.

5. The reel spooling device of claim 1, wherein the guide cartridge includes a third pair of rollers which are spaced relative to each other and each rotatable about a fifth axis and a sixth axis respectively, the third pair of rollers forming a third restriction.

6. The reel spooling device of claim 5, wherein the fifth axis and the sixth axis are generally perpendicular to the first axis, the second axis, the third axis, and the fourth axis.

7. The reel spooling device of claim 5, wherein the third pair of rollers are located between the first pair of rollers and the second pair of rollers.

8. The reel spooling device of claim 1, wherein each roller has a right circular cylinder roller surface.

9. The reel spooling device of claim 1, wherein the removable tooth holder is attached to a body portion of the guide cartridge with a pair of bayonet connections or one or more fasteners.

10. The reel spooling device of claim 9, wherein the bayonet connections are releasable by squeezing a pair of wings formed on the removable tooth holder.

11. The reel spooling device of claim 1, wherein the guide cartridge includes upper and lower projections which each extend generally parallel with the lead screw, the upper and lower projections being mounted in corresponding upper and lower channels formed within a housing unit of the reel spooling device, and wherein the upper and lower projections are slidable within the corresponding upper and lower channels.

12. The reel spooling device of claim 1, wherein the overlaid left and right-hand threads are interconnected and form a continuous thread which loops back on itself.

13. The reel spooling device of claim 1, wherein the first pair of rollers are stepped in diameter.

14. The reel spooling device of claim 1, further comprising a spring or a motorized mechanism configured to drive a spool.

15. A reel spooling device comprising:

a reel adapted to store a spooled length of hose or conduit;

a lead screw configured to rotate about a longitudinal axis when the reel rotates; and a guide cartridge seated on the lead screw, the guide cartridge configured to reciprocate between opposing first and second ends of said lead screw, wherein the guide cartridge includes:

a first pair of rollers which are spaced relative to each other and each rotatable about a first axis and a second axis respectively, the first pair of rollers forming a first restriction; and a second pair of rollers which are spaced relative to each other and each rotatable about a third axis and a fourth axis respectively, the second pair of rollers forming a second restriction, wherein the first axis, the second axis, the third axis, and the fourth axis are each generally parallel, wherein the first restriction and the second restriction are separated relative to a longitudinal direction in which the hose or conduit passes through the guide cartridge, wherein the guide cartridge includes upper and lower projections which each extend generally parallel with the lead screw, the upper and lower projections being mounted in corresponding upper and lower channels formed within a housing unit of the reel spooling device, and wherein the upper and lower projections are slidable within the corresponding upper and lower channels.

16. The reel spooling device of claim 15, wherein each of the first axis, the second axis, the third axis, and the fourth axis extend generally vertically and are perpendicular to the longitudinal axis.

17. The reel spooling device of claim 15, wherein the lead screw is mechanically coupled to the reel.

18. The reel spooling device of claim 15, wherein the lead screw is driven by an electric motor.

19. The reel spooling device of claim 15, wherein each roller has a right circular cylinder roller surface.

20. The reel spooling device of claim 15, wherein the guide cartridge includes a third pair of rollers which are spaced relative to each other and each rotatable about a fifth axis and a sixth axis respectively, the third pair of rollers forming a third restriction.

* * * * *